US007246589B2

(12) United States Patent
Karbstein et al.

(10) Patent No.: US 7,246,589 B2
(45) Date of Patent: Jul. 24, 2007

(54) VALVE TRAIN OF AN INTERNAL COMBUSTION ENGINE COMPRISING A TAPPET AND A TAPPET PUSHROD

(75) Inventors: Henning Karbstein, Adelsdorf (DE); William Carter, Macomb, MI (US); David Kehr, Dearborn, MI (US)

(73) Assignee: Schaeffler KG, Herzogenaurach (DE)

( * ) Notice: Subject to any disclaimer, the term of this patent is extended or adjusted under 35 U.S.C. 154(b) by 56 days.

(21) Appl. No.: 11/304,460

(22) Filed: Dec. 15, 2005

(65) Prior Publication Data

US 2006/0130794 A1 Jun. 22, 2006

Related U.S. Application Data

(60) Provisional application No. 60/637,273, filed on Dec. 17, 2004.

(51) Int. Cl.
*F01L 1/14* (2006.01)

(52) U.S. Cl. ..... 123/90.61; 123/90.48; 123/90.35; 123/90.55; 74/569; 74/587

(58) Field of Classification Search ..... 123/90.61
See application file for complete search history.

(56) References Cited

U.S. PATENT DOCUMENTS

| | | | | |
|---|---|---|---|---|
| 2,857,895 | A * | 10/1958 | Scheibe | 123/90.35 |
| 3,054,392 | A * | 9/1962 | Thompson | 123/90.35 |
| 3,144,010 | A | 8/1964 | Van Slooten | |
| 3,908,615 | A * | 9/1975 | Hayward | 123/90.35 |
| 4,602,597 | A | 7/1986 | Rhoads | |
| 7,077,090 | B2 * | 7/2006 | Sailer et al. | 123/90.52 |
| 7,174,870 | B2 * | 2/2007 | Rutsey | 123/90.61 |

FOREIGN PATENT DOCUMENTS

| | | |
|---|---|---|
| DE | 19 83 334 U | 4/1968 |
| DE | 19 92 038 U | 8/1968 |
| DE | 33 43 324 A1 | 6/1984 |
| DE | 10 2004 019 282 A1 | 12/2005 |

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

The invention proposes a valve train of an internal combustion engine comprising a tappet (7) and a tappet pushrod (1) that is actuated by said tappet (7), said tappet pushrod (1) being at least partly hollow and comprising on one end (3), a first support (4) for an at least indirectly contacting pressure piston (5) of a hydraulic lash adjuster (6) of said tappet (7) that follows a periodic driving element, typically a cam. A second support (9) for a follower member (2), typically a rocker arm, is arranged on a further end (8) of the tappet pushrod (1). The first support (4) comprises a passage (10) for hydraulic medium that can be routed out of the pressure piston (5) during operation of the internal combustion engine into an interior (11) of the tappet pushrod (1), wherein a pipette means (12) is installed in the tappet pushrod (1) for retaining a hydraulic medium column during a standstill of the internal combustion engine. Through the pipette means (12) of the invention, an additional volume of hydraulic medium is available for a rapid filling of the reservoir enclosed by the pressure piston (5) with pressure medium after a re-starting of the internal combustion engine, so that a proper lash adjusting operation is guaranteed from the very beginning.

6 Claims, 2 Drawing Sheets

VALVE TRAIN OF AN INTERNAL COMBUSTION ENGINE COMPRISING A TAPPET AND A TAPPET PUSHROD

The application claims the benefit of provisional patent application Ser. No. 60/637,273 filed Dec. 17, 2004.

FIELD OF THE INVENTION

The invention concerns a valve train of an internal combustion engine comprising a tappet and a tappet pushrod that is actuated by said tappet, said tappet pushrod being at least partly hollow and comprising on one end, a first support for an at least indirectly contacting pressure piston of a hydraulic lash adjuster of said tappet that follows a periodic driving element, typically a cam, a second support for a follower member, typically a rocker arm, being arranged on a further end of the tappet pushrod, said first support comprising a passage for hydraulic medium that can be routed out of the pressure piston during operation of the internal combustion engine into an interior of the tappet pushrod.

BACKGROUND OF THE INVENTION

A valve train of the pre-cited type is disclosed in U.S. Pat. No. 6,196,175 B1. The tappet of this valve train is configured as a switchable roller tappet and is installed in a relatively strongly restricted mounting space, so that only an inadequate quantity of hydraulic medium can be contained in its pressure piston. However, in various situations such as upon re-firing of the internal combustion engine after a longer standstill, "taxi operation" etc., this hydraulic medium proves to be insufficient for a proper lash adjusting operation of the lash adjuster. Therefore, a relatively high risk of a re-aspiration of air into the high pressure chamber of the lash adjuster exists with all the drawbacks, like rattling noises, wear etc., known in the technical field.

Moreover, it is usual in OHV trains comprising a roller tappet and a tappet pushrod to lubricate further components like rocker arms, cam-contacting surfaces etc. that are situated at a high geodetic level, through a hollow tappet pushrod. This is also disclosed in the pre-cited U.S. Pat. No. 6,196,175, while U.S. Pat. No. 3,908,615 likewise discloses a hollow tappet pushrod. Further, U.S. Pat. No. 5,351,662 shows a tappet configured as a roller tappet in which it can be seen that, for design reasons, the hydraulic lash adjuster can contain only a very small quantity of hydraulic medium.

OBJECTS OF THE INVENTION

It is an object of the invention to provide a valve train of the pre-cited type in which the aforesaid drawbacks are eliminated.

This and other objects and advantages of the invention will become obvious from the following detailed description.

SUMMARY OF THE INVENTION

The invention achieves the above objects by the fact that a pipette means is installed in the tappet pushrod for retaining, during a standstill of the internal combustion engine, a hydraulic medium column which, as viewed in gravity direction, is situated under the pipette means.

In this way, the initially mentioned drawbacks are effectively eliminated. Thus, when the internal combustion engine is switched off, the oil accumulated in the interior of the tappet pushrod is retained after the principle of a pipette as an additional reserve. When the internal combustion engine is started, this hydraulic medium can flow into the reservoir of the pressure piston.

The corresponding one-way valve body, such as, for example, a ball, a plate, a cone or the like opens immediately upon re-firing of the internal combustion engine due to the then occurring vibrations. Thus, from the very beginning, an adequate quantity of hydraulic medium is available for avoiding the aforesaid rattling noises. Even during so-called "taxi operation", i.e. during extreme short-distance driving, it is guaranteed that a sufficient quantity of hydraulic medium always accumulates in the reservoir, so that a re-aspiration of air is avoided.

According to a further feature of the invention, the second support of the tappet pushrod, i.e. the support on the rocker arm side also comprises a passage for the hydraulic medium. The pipette means of the invention is preferably intended to simultaneously act as a choke for limiting the flow of hydraulic medium to this passage. Thus only a defined small quantity of hydraulic medium flows to the higher-lever lubrication points while a larger part of the hydraulic medium is available for lash adjustment.

According to still another feature of the invention, a bushing (solid or thin-walled, for example, of sheet metal) comprising the pipette means on one of its collars and the choke on its other collar can be installed in the tappet pushrod. It is clear that the bushing may be arranged at any height in the tappet pushrod, preferably, however, it is arranged at a very high geodetic level so that, after the internal combustion engine is shut off, a sufficiently high hydraulic medium column, retained after the principle of a pipette, is formed under the bushing.

The through-openings on the second support of the bushing may be formed, for instance, by leaf spring-like tongues or by rib-like circumferential projections or the like. It is also conceivable to simply perforate the collar in this region.

It is further proposed to make the tappet pushrod of at least two separate, fabricated sections with a cylindrical part situated therebetween in which the pipette means and the choke are configured. This fabricated embodiment has, for example, the advantage that the tappet pushrod as a whole is simpler to integrate in different surrounding structures. According to a further feature of the invention, a connection between the fabricated sections is achieved through the aforesaid two-piece cylindrical part whose one end comprises the sealing valve seat and whose other end comprises the stop for the closing body which is arranged for slight axial displacement between these ends and is configured, for example, as a ball, a double-taper cone, a plate of the like.

It is clear that such a fabricated tappet pushrod, i.e. a pushrod made up of a plurality of inter-inserted sections can also be generally used even if it does not comprise the pipette means or the choke of the invention.

According to a final proposition of the invention, the supports of the tappet pushrod are configured as ball heads. These can be made separately, but a one-piece configuration with the tappet pushrod is also within the scope of the invention. In place of the ball heads, supports of other configurations such as pan-like or cylindrical shapes etc. will also occur to a person skilled in the art.

The invention will now be described more closely with reference to the appended drawing

DETAILED DESCRIPTION OF THE DRAWING

Figure 1:
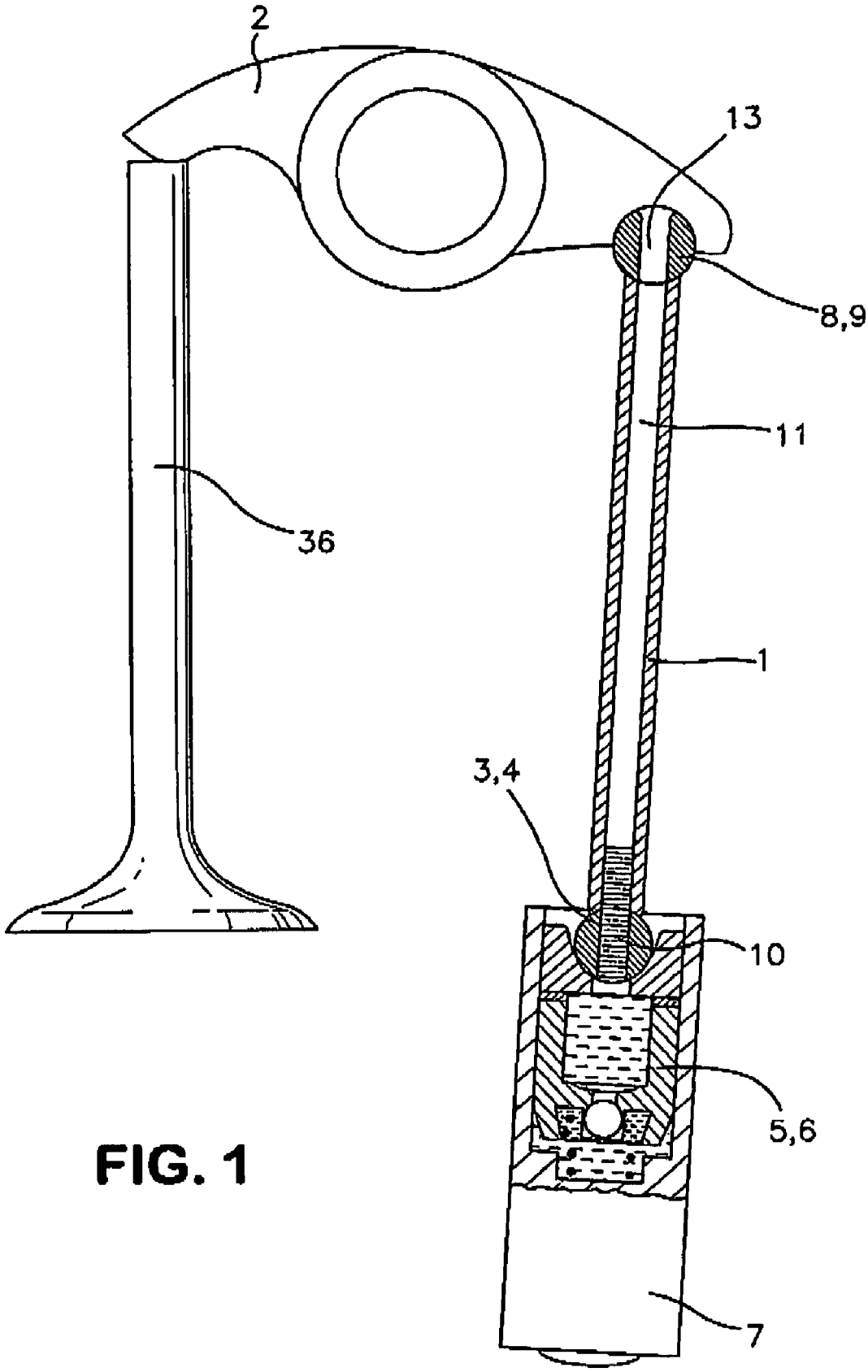
FIG. 1 is a schematic representation of a valve train comprising a tappet and a tappet pushrod.

FIG. 1 discloses an OHV train comprising a cam-actuated tappet 7 that acts at one end on a hollow tappet pushrod 1. At this end, the tappet pushrod 1 comprises a first support 4 that is configured as a ball head and is seated on a pressure piston 5 of a hydraulic lash adjuster 6 of the tappet 7. On its other end 8, the tappet pushrod 1 comprises a second support 9 that is likewise configured as a ball head and acts on a follower member 2 configured as a rocker arm.

As can be seen from the figures, the tappet pushrod 1 has a generally hollow configuration, so that hydraulic medium can be routed through its interior 11 to the follower member 2. The hydraulic medium is routed out of the space enclosed by the pressure piston 5, through a first passage 10 in the region of the one end 3 of the tappet pushrod 1, the interior 11 of the tappet pushrod 1 and a second passage 13 in the region of the other end 8, to lubrication points on the follower member 2. FIG. 1 illustrates schematically, a rising hydraulic medium column as is formed after starting of the internal combustion engine.

As already described above, when the internal combustion engine is turned off, the hydraulic medium column in the pressure piston 5 sinks, under certain circumstances, below an adequate minimum, so that when the engine is re-fired, not enough hydraulic medium for lash adjustment can be re-suctioned into a high pressure chamber of the hydraulic lash adjuster 6. In the most unfavorable of cases, a re-aspiration of air then takes place.

To avoid these serious drawbacks, precisely as can be encountered in the case of very small hydraulic medium reservoirs in confined mounting spaces, it is proposed to arrange a pipette means 12 in the tappet pushrod 1 to retain the hydraulic medium column during a standstill of the internal combustion engine.

Figure 2:
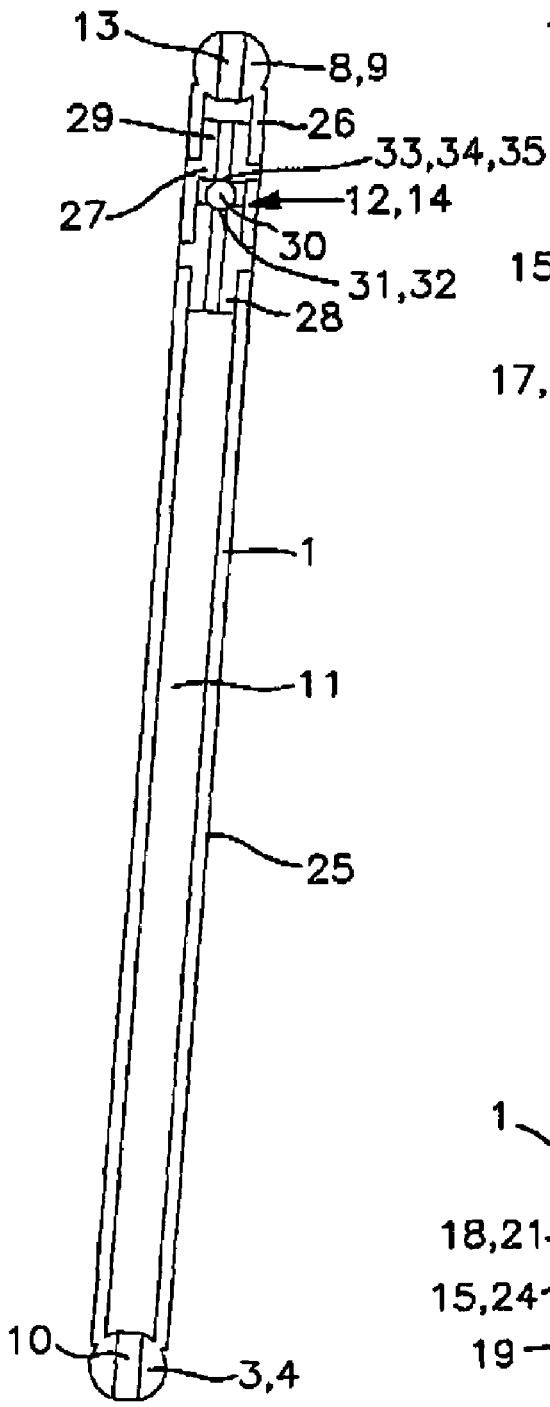
FIG. 2 is a view of the tappet pushrod comprising a pipette means and a choke of the invention.
Figure 3:
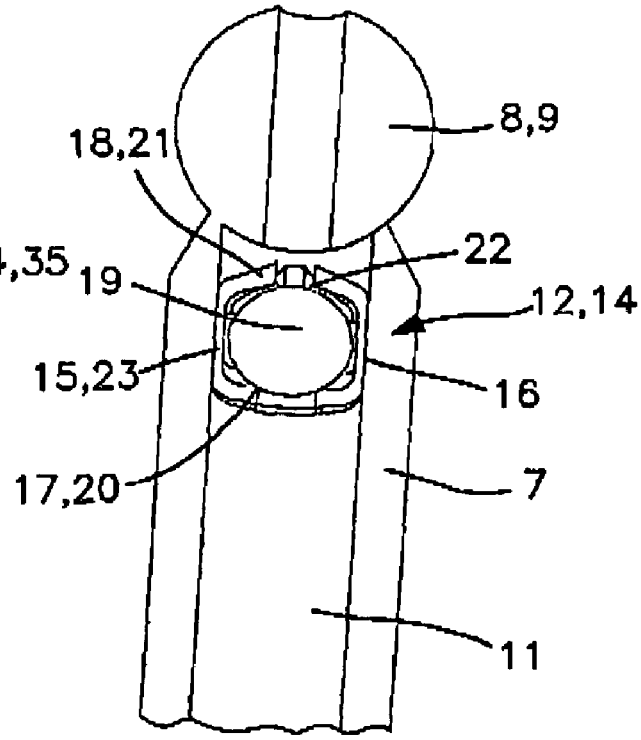
FIG. 3 is another view of the tappet pushrod comprising the pipette means and the choke of the invention.
Figure 4:
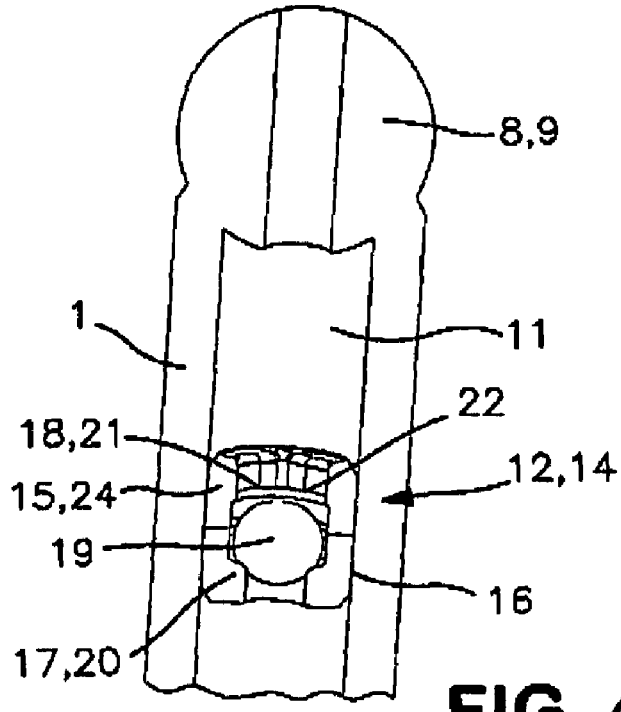
FIG. 4 is still another view of the tappet pushrod comprising the pipette means and the choke of the invention.

As best seen in FIGS. 2-4, a choke 14 is likewise created in the region of the pipette means 12 to limit the flow of hydraulic medium to the passage 13 in the second support 9. It is understood that this choke 14 may also be configured separately from the pipette means 12.

As shown in FIG. 2, the tappet pushrod 1 is composed of two separate, fabricated sections 25, 26. The section 25 comprises the first support 4, while the section 26 comprises the second support 9. A cylindrical part 27, made up of two parts, extends between the sections 25 and 26 and connects them to each other. As can be seen in the upper portion of FIG. 2, each of the upper and the lower part of the cylindrical part 27 possesses a stub-like extension 28, 29 pointing away from each other. The extension 28 is inserted into the section 25 of the tappet pushrod 1 while the extension 29 is inserted into the section 26 of the tappet pushrod 1.

A closing body 30, configured in the present embodiment as a ball, extends for slight axial displacement between the two parts of the cylindrical part 27. A sealing valve seat 32 for the closing body 30 is formed on an inner end face 31 of the (lower) extension 28. The pipette means 12 is thus created.

A stop 34 comprising a plurality of circumferentially spaced through-openings 35 for the hydraulic medium is formed in the region of an inner end face 33 of the upper part of the two-piece cylindrical part 27. This results in the formation of the choke 14 in this region.

During the operation of the internal combustion engine, i.e. under prevailing hydraulic medium pressure, the closing body 30 is pressed against the stop 34 of the upper part of the cylindrical part 27, so that a small quantity of hydraulic medium can flow past this toward the follower member 2. When the internal combustion engine is shut off, the closing body 30 drops onto its valve seat on the inner end face 31. With this, as already mentioned above, the pipette means 12 becomes effective and the hydraulic medium accumulated in the interior 11 of the tappet pushrod 1 is retained and is available for a rapid re-filling of the reservoir in the pressure piston 5 of the lash adjuster 6 when the internal combustion engine is re-started. The hydraulic medium is released when the closing body 30 lifts off its valve seat 32 as a result of the vibrations that set in as soon as the internal combustion engine is started.

According to FIG. 3, a bushing 15, configured here as a thin-walled sheet metal part 23 extends within the tappet pushrod 1. The bushing 15 is fixed in position through its outer peripheral surface 16 in the interior 11 of the tappet pushrod 1, preferably in an upper region thereof. The bushing 15 comprises two axially opposing annular collars 17, 18. A closing body 19, configured in this embodiment as a ball, extends for slight axial displacement between these annular collars 17, 18. A sealing valve seat 20 for the closing body 19 is configured on the lower annular collar 17, so that the pipette means 12 is formed in this region. The upper annular collar 18, in contrast, serves as a stop 21 for the closing body 19 and comprises in the present embodiment, circumferentially spaced leaf spring-like tongues between which the through-openings 22 for the hydraulic medium are formed. The mode of functioning of the pipette means 12 and the choke 14 of this and of the embodiment shown in FIG. 4, corresponds to the description given in connection with FIG. 2.

According to FIG. 4, the bushing 15 is made as an extruded part 24, i.e. it has a generally solid configuration. The annular collar 18 of this bushing 15 facing the second support 9 comprises on an inner surface, rib-like circumferential projections between which the through-openings 22 of the choke 14 are formed. FIG. 4 shows the closing body 19 in abutment against its valve seat 20 in the region of the lower annular collar 17.

The invention claimed is:

1. A valve train of an internal combustion engine comprising a tappet and a tappet pushrod that is actuated by said tappet, said tappet pushrod being at least partly hollow and comprising on one end, a first support for an at least indirectly contacting pressure piston of a hydraulic lash adjuster of said tappet that follows a periodic driving element, typically a cam, a second support for a follower member, typically a rocker arm, being arranged on a further end of the tappet pushrod, said first support comprising a passage for hydraulic medium that can be routed out of the pressure piston during operation of the internal combustion engine into an interior of the tappet pushrod, wherein a pipette means is installed in the tappet pushrod for retaining, during a standstill of the internal combustion engine, a hydraulic medium column which, as viewed in gravity direction, is situated under the pipette means, the second support comprises a passage for hydraulic medium to the follower member and the pipette means is configured at the same time as a choke for limiting a hydraulic medium flow to the passage of the second support, or a choke for limiting a hydraulic medium flow is associated to the pipette means, a bushing is installed in the tappet pushrod, which bushing is one of fixed in position in the interior of the tappet pushrod or is a part of the tappet pushrod and comprises two axially opposing annular collars between which a closing body, typically a ball, extends for slight displacement, a sealing valve seat for the closing body for forming the pipette means is generated on that one of the annular collars that faces the first support, and a stop for the closing body comprising at least one through-opening for forming a choke for the hydraulic medium extends on that one of the annular collars that faces the second support.

2. A tappet pushrod of claim 1, wherein the bushing is made as a thin-walled sheet metal part and the annular collar facing the second support comprises leaf spring-like tongues between which the through-openings are formed.

3. A tappet pushrod of claim 1, wherein the bushing is configured as one of a solid or an extruded part, and the annular collar facing the second support comprises on an inner side, rib-like circumferential projections between which the through-openings are formed.

4. A tappet pushrod of claim 1, wherein the tappet pushrod comprises at least two fabricated sections, a first one of these sections comprises the first support and a second one of these sections comprises the second support, and the two sections are connected by a cylindrical part comprising the pipette means and the choke.

5. A tappet pushrod of claim 4, wherein the cylindrical part is made up of two parts and comprises stub-like extensions pointing away from each other, each extension being inserted into one of the sections, said extensions are likewise inserted into each other at inner axial ends and enclose an intermediate closing body, typically a ball, a sealing valve seat for the closing body for forming the pipette means is configured on an inner end face of one of the extensions and a stop for the closing body comprising a choke in the form of at least one through-opening for the hydraulic medium is configured on an inner end face of the other of the extensions.

6. A tappet pushrod of claim 1 wherein the supports of the tappet pushrod are configured as ball-heads.

* * * * *